United States Patent [19]

Sullivan

[11] Patent Number: 4,848,122

[45] Date of Patent: Jul. 18, 1989

[54] METHOD AND APPARATUS FOR DEBURRING USING SHOT

[75] Inventor: Mark P. Sullivan, San Diego, Calif.

[73] Assignee: Chemtronics, El Cajon, Calif.

[21] Appl. No.: 75,534

[22] Filed: Jul. 20, 1987

[51] Int. Cl.[4] ..... B21J 5/00

[52] U.S. Cl. ..... 72/53; 29/9; 29/90.7; 51/419; 51/320

[58] Field of Search ..... 72/53; 51/419, 420, 51/421, 410, 319, 320; 29/90 A

[56] References Cited

U.S. PATENT DOCUMENTS

| | | | |
|---|---|---|---|
| 937,180 | 10/1909 | Ridd | 72/53 |
| 3,705,511 | 12/1972 | Brandel et al. | 72/53 |
| 4,423,613 | 1/1984 | DeClark et al. | 72/53 |
| 4,432,220 | 2/1984 | Loersch et al. | 72/53 |

FOREIGN PATENT DOCUMENTS

| | | | |
|---|---|---|---|
| 89620 | 9/1983 | European Pat. Off. | 51/419 |
| 102756 | 6/1982 | Japan | 51/419 |
| 621564 | 8/1978 | U.S.S.R. | 51/419 |

*Primary Examiner*—David Jones
*Attorney, Agent, or Firm*—Frank D. Gilliam

[57] ABSTRACT

A self-limiting method and apparatus for deburring or rounding sharp edges. Structures which basically comprise a skin which is a surface of revolution with a plurality of upstanding ribs in a pattern forming pockets often have sharp edges on the sides of the ribs, formed by chemical milling or machining operations, with the edges lying along lines substantially parallel to the skin. It is necessary to deburr or round over these sharp edges without damaging or deforming the ribs or skin. To accomplish this, the structure is mounted on a fixture which permits the structure to be rotated around its axis of rotation while the axis is tilted at selected angles. The fixture is positioned above a hopper containing hard, small balls (usually steel). An elevator mechanism lifts the balls to a dispenser above the fixture which has appropriately located slots above the sharp edges to be rounded. Balls are allowed to fall through the slots onto the sharp edges and adjacent areas. The edges gradually rounded over by the impact of the falling balls. When ball size and drop height are properly selected, the edges will be deformed only to the desired radius, after which further impacts have no significant further effect. Adjacent areas of the ribs are substantially uneffected by ball impact. The thin skin areas at the bottom of the pockets are not damaged, since the balls strike the skin at low, glancing angles.

11 Claims, 2 Drawing Sheets

METHOD AND APPARATUS FOR DEBURRING USING SHOT

BACKGROUND OF THE INVENTION

This invention relates to the automatic rounding or deburring of sharp edges on rib sides through shot impact.

A number of high strength, light weight, duct-like structures for airplane, spacecraft or other applications are manufactured by machining or chemical milling a pattern of pockets surrounded by upstanding ribs over the outer surface of a metal workpiece which is a surface of revolution. For an optimum combination of high strength and light weight, the ribs often have non-uniform thicknesses in selected regions. When produced, these ribs often have sharp edges along their sides, along lines substantially parallel to the inner skin surface, especially along boundaries of different rib thickness regions.

It is necessary that these sharp edges be deburred; that is, removed or rounded off because the high stress concentrations at the sharp edges can cause stress cracking and to eliminate the hazard of cutting fingers and hands while handling the component during the manufacturing process. In the past, these sharp edges have been manually deburred, using buffers, scrapers or grinders. These methods are labor intensive, require considerable skill, often require careful hand work in corners or other inaccessible areas and can damage parts, requiring careful inspection and rework, often resulting in unacceptable scrap rates.

Impacting metal surfaces with high velocity particles, such as sand particles or steel or ceramic shot, has long been used to clean the surface of contaminants or scale and flash. Shot peening with small metal balls is widely used to work harden metal surfaces such as turbine blades by increasing surface stresses in the workpiece. Dropping or propelling metal shot against metal surfaces can also smooth and polish the surfaces.

One problem with shot peening has been the tendency to damage edges when peening a workpiece. Neal, et al., in U.S. Pat. No. 4,426,867, describe a method and apparatus for peening airfoils and thin edged workpieces which avoids impact at edges to avoid damage, teaching that the shot streamline should be kept away from edges.

A number of patents, such as U.S. Pat. No. 4,067,240 to Straub, show apparatus for shot peening in which shot from a hopper below a workpiece is lifted by a conveyor or elevator to a hopper having a bottom opening through which the shot falls, impacting the workpiece and returning to the hopper. These prior devices are effective in uniformly peening the entire surface of a workpiece, but are incapable of peening only selected areas without impacting adjacent, more damage sensitive, areas.

In some cases, as described in U.S. Pat. No. 4,228,671 by Skeen, the entire workpiece is first peened with large shot to improve surface strength, but then must be peened with finer shot to provide an acceptably smooth appearance.

In order to uniformly peen round workpieces, such as gears, shafts, or the like, it is necessary to rotate the workpiece. Young, et al., in U.S. Pat. No. 2,542,955, attach paddlewheels to the ends of such parts and allow the shot to strike the paddlewheel in a manner causing the workpiece to rotate. This is a somewhat cumbersome device and requires the shot stream to cover a large area, preventing careful direction of the stream against selected areas. Other complex moving devices have been developed for moving long or large workpieces past nozzles which spray shot entrained in high velocity air streams at the workpieces. Typical of these is the apparatus described in U.S. Pat. No. 2,982,007 by Fuchs, et al. These devices tend to be large, complex, require air streams to carry shot and are not easily adjustable to handle different workpieces.

Compton, in U.S. Pat. No. 3,485,074, describes an apparatus for cleaning and deburring small holes in metal structures by manually directing a small, high velocity air stream with small glass beads entrained therein against the surface to be treated. This apparatus is not capable of automatically treating selected areas of large structures and requires a complex air stream generating means and bead entrainment means.

Thus, there is a continuing need for improved methods and apparatus for deburring or rounding sharp edges on ribs of large duct-like structures. While round media are used in several known techniques for increasing residual stresses in metal surface and for cleaning or smoothing such surfaces, nothing in the industry suggests any way that round media could be adapted to overcome that problem.

SUMMARY OF THE INVENTION

The above-noted problems, and others, are overcome by the apparatus and method of this invention which uses gravity-propelled shot to automatically and selectively round or deburr sharp edges on outwardly-extending ribs on a skin which is a surface of revolution. A structure having edges to be treated is mounted in a movable fixture above a hopper containing a quantity of shot. An elevator mechanism lifts shot from the hopper to a dispenser above the structure. Adjustable slots in the bottom of the dispenser allow shot to fall in a selected pattern against selected areas of the structure. The fixture holds the structure in a manner allowing rotation of the structure about its axis of rotation, while simultaneously allowing the structure axis to be tilted.

Ribs running parallel to the structure axis can be peened by rotating the structure about its axis with the axis substantially perpendicular to the stream of falling shot, with the stream being formed by the slots into one or two elongated narrow streams striking the ribs substantially tangentially to the structure. The stream thus will directly impact the sharp edges while striking the thin skin between ribs at a small, glancing angle.

Ribs running circumferentially on the structure are treated by rotating the structure with the axis of rotation at a small angle to the stream of falling shot. One side of the circumferential ribs is treated with the structure pointed up, the other side with the structure pointed down. Again, the shot will directly impact the sharp edges while striking only a glancing blow against the skin.

I have found that by selecting the shot density and diameter and adjusting the height of shot fall, shot impact will gradually round the sharp edges to a uniform rounded radius, after which there will no longer be further significant deformation of the edges. The impacts are insufficient to significantly deform the rib areas between sharp edges. The low angle, glancing impact of shot against the thin skin between ribs is so slight as to prevent any significant deformation of the skin.

This apparatus and method produce uniform deburring or rounding of sharp edges automatically. Once full rounding occurs, leaving the machine in operation longer, causes no further changes. An operator simply adjusts the workpiece orientation and hopper location, turns the machine on, performs other tasks, then turns the machine off and readjusts the machine for the next step.

BRIEF DESCRIPTION OF THE DRAWING

Details of the invention, and of preferred embodiments thereof, will be further understood upon reference to the drawing, wherein.

DETAILED DESCRIPTION OF THE INVENTION

Figure 1:
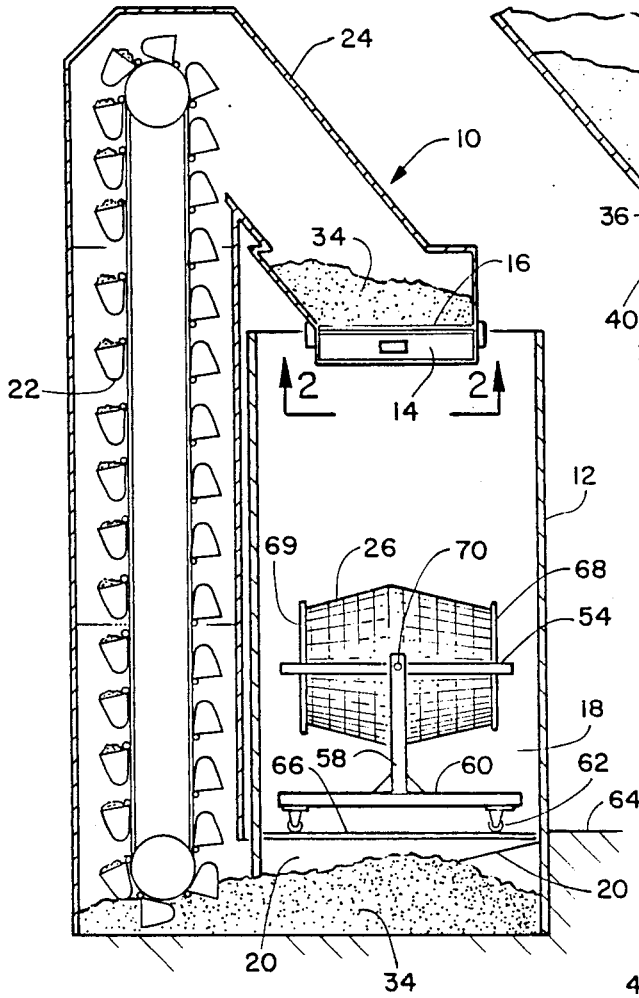
FIG. 1 is a schematic elevation view of the shot deburring apparatus.

Referring now to FIG. 1, there is seen a simplified schematic elevation view of an apparatus 10 for shot deburring of sharp edges on the sides of ribs on a structure which is a surface of revolution. Conventional covers enclosing the apparatus have been removed to reveal interior components.

An open framework 12 supports a set of elongated dispensing hoppers 14 mounted on crossbars 16 at the top of framework 12. If desired, the hoppers may be made movable along crossbars 16 to vary the location of the hoppers. At approximately the center of framework 12 is positioned a fixture 18 adapted and dimensioned to support a structure to be deburred. At about the bottom of framework 12 is located a hopper 20 which collects shot falling past fixture 18 and directs it to the bottom of a lifting mechanism 22 at the side of framework 12. Lifting mechanism 22 carries shot upwardly, such as by a endless-bucket type elevator, to duct 24 which direct shot selectively to one or more of the hoppers in hopper set 14 which makes up the shot dispensing means.

Figure 10:
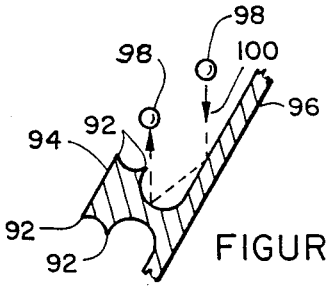
FIG. 10 is a schematic sectional view through a typical rib illustrating the impact of shot on non-edge areas.
Figure 9:
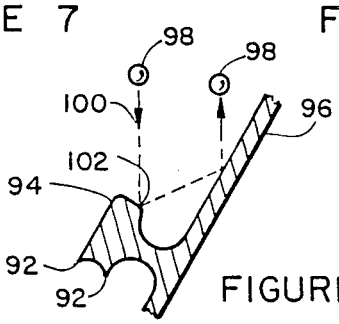
FIG. 9 is a schematic sectional view through a typical rib illustrating the deburring action of a shot impact.

This apparatus is specifically adapted to deburr sharp edges lying along the sides of ribs on a structure which comprises a skin which is a surface of revolution (typically frusto-conical) having a plurality of ribs extending outwardly from the skin, often forming a pattern of pockets. Such ribs have sharp edges lying along lines parallel to the skin surface, formed by chemical milling or machining operations. One typical structure is that shown at 26 which is formed of two frusto-conical sections joined base-to-base. Structure 26 has an inner skin with a plurality of upstanding ribs in a rectangular arrangement. The configuration of typical ribs is shown in FIGS. 9 and 10 as described below.

Figure 3:
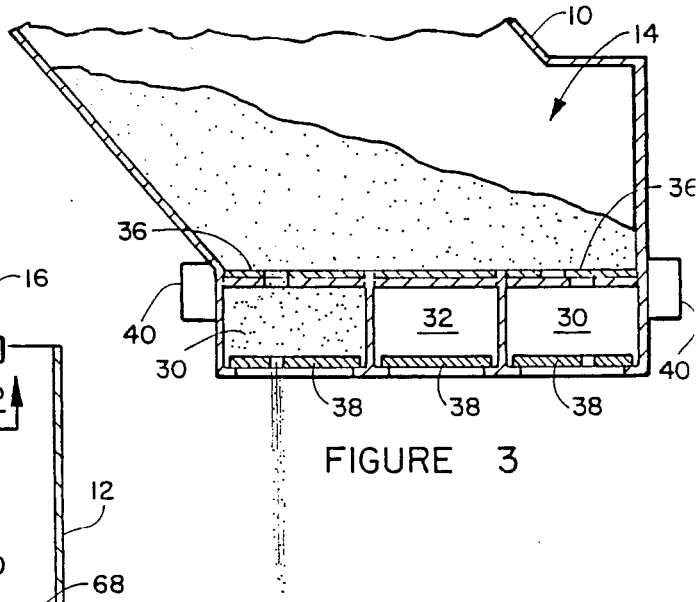
FIG. 3 is a schematic section view taken on line 3—3 in FIG. 2.
Figure 2:
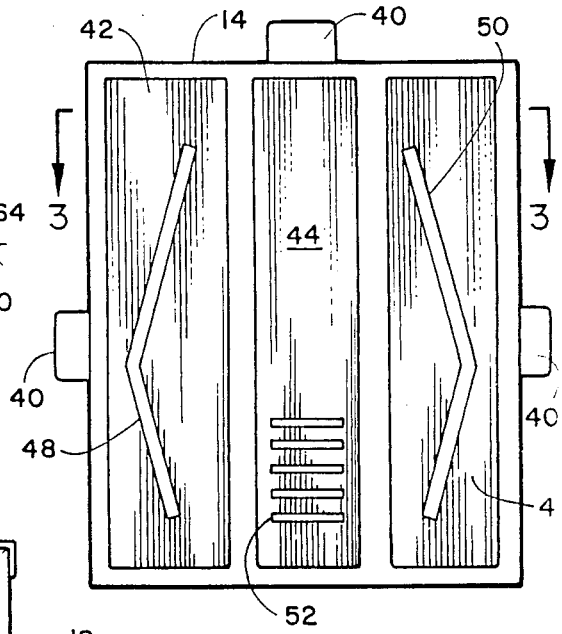
FIG. 2 is a view looking upwardly along line 2—2 in FIG. 1.

A typical assembly of hoppers 14 is shown in an upwardly directed plan view in FIG. 2 and in schematic section in FIG. 3. In this example, two outer hoppers 30 and one central hopper 32 are provided. Each of these hoppers 30 and 32 receive shot 34 through duct 10. Any suitable mechanism may be used to selectively allow or prevent shot 34 from entering each of the hoppers 30 and 32. As seen in FIG. 2, removable slotted plates 42, 44 and 46 are placed in the bottoms of hoppers 30 and 32. Slots 48 and 50 conform in shape to the profile of structure 26, looking downwardly in FIG. 1 toward the structure from the hopper set 14. These slots 48 and 50 direct shot against longitudinal ribs, as described in conjunction with the description of FIG. 6, below. Transverse slots 52 are sized and positioned in plate 44 to direct shot against circumferential ribs, as shown in FIGS. 7 and 8, as detailed below.

Figure 4:
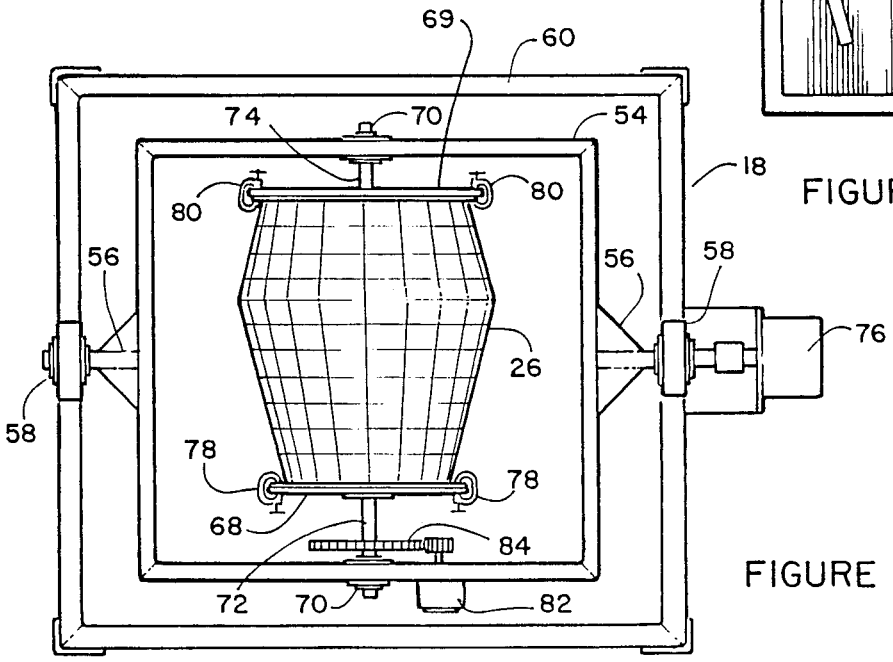
FIG. 4 is a schematic plan view of the structure supporting fixture.
Figure 5:
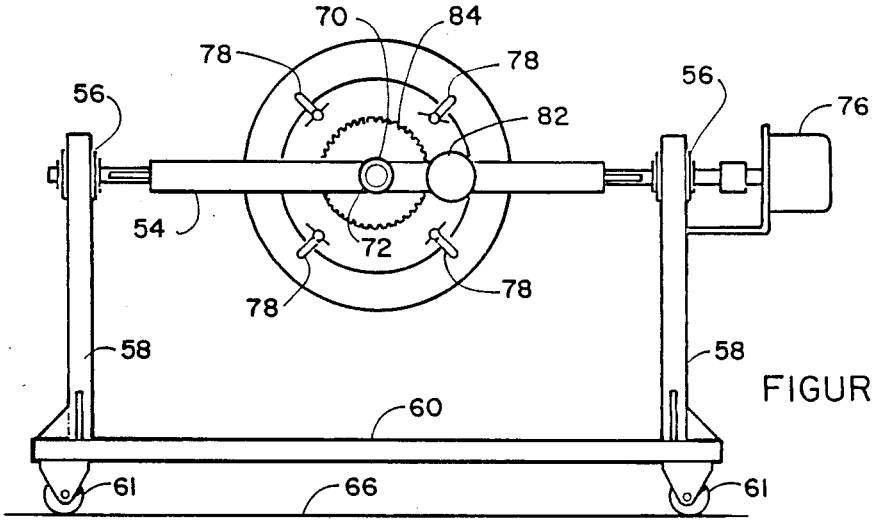
FIG. 5 is a schematic elevation view of the structure supporting fixture.

Fixture 18 is adapted to support and align such a structure 26 with streams of shot falling from dispensing hopper set 14 toward collection hopper 20. Fixture 18 is best seen in FIGS. 1, 4 and 5. A generally rectangular frame 54 is sized to surround a structure 26 to be deburred. A pair of pivot means 56 extend between framework 58 and frame 54 and permit the structure to be pivoted to a selected angle between the structure axis and the shot streams. Framework 58 is mounted on a truck 60 on casters 61 which permit the fixture to be rolled into and out of the assembly from an outside floor 62 to plates 66. Bars or circular plates 68 and 69 are rotatably mounted on frame 54 through pivot means 70 and are adapted to securely engage and clamp structure 26 in place by any suitable releasable clamping means. Typically, (as seen in FIG. 4) plate 68 may be rigidly or releasably secured to a first tubular shaft 72. A second, solid, shaft 74 is releasably secured to plate 69 and telescopes into tubular shaft 72.

The fixture may be assembled by turning shafts 56 by a conventional low-speed motor 76 so that plate 68 is down, placing structure 26 thereon and locking structure 26 to plate 68 by a conventional means such as C-clamps 78. Then plate 69 is positioned on the upper end of structure 26 and shaft 74 is inserted through pivot 70 and plate 69 and into tubular shaft 72. Plate 69 is secured to structure 26 by C-clamps 80 and shaft 74 is locked in place, such as by collars (not shown) adjacent to plate 69 and pivot 70.

A low speed motor 82 and gear assembly 84 are positioned on frame 54 to rotate structure 26 about its axis within frame 54.

In use, frame 54 is adjusted to place the axis of structure 26 at the desired angle, selected ones of dispensing hoppers 30 and 32 are positioned to direct shot streams against the desired areas on structure, motor 82 is turned on to rotate structure 26, lifting mechanism 22 is activated and shot is allowed to fall from the dispensing hoppers against the structure until deburring is complete, whereupon the apparatus is stopped, fixture 18 and the dispensing hoppers are readjusted to allow shot streams to fall against other areas and the apparatus is reactivated. This sequence is repeated until all desired areas have been deburred. The plates 68 and 69 are unclamped from the structure 26 which is then removed from the apparatus.

While the apparatus as illustrated in FIG. 1 is considerably simplified for clarity, the apparatus when used in production will have the usual conventional covers, doors, motor controls, etc. As is detailed below, the time of shot deburring is not critical, since sharp edges will round only to a certain radius produced by a specific combination of shot density, size and drop distance. With this apparatus impacts of shot against other rib areas and the skin will cause no significant adverse effects.

Figure 6:
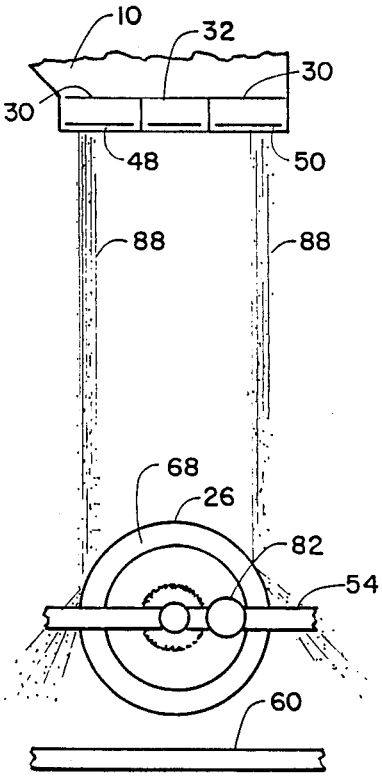
FIG. 6 is a schematic elevation view illustrating deburring of longitudinal ribs.
Figure 7:
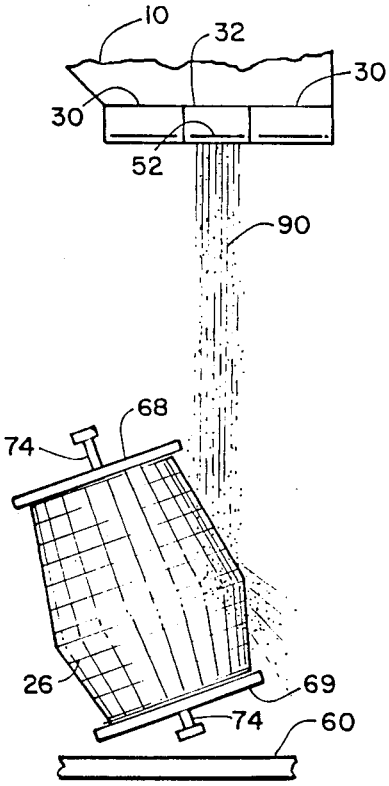
FIG. 7 is a schematic elevation view illustrating deburring of a first side of circumferential ribs.
Figure 8:
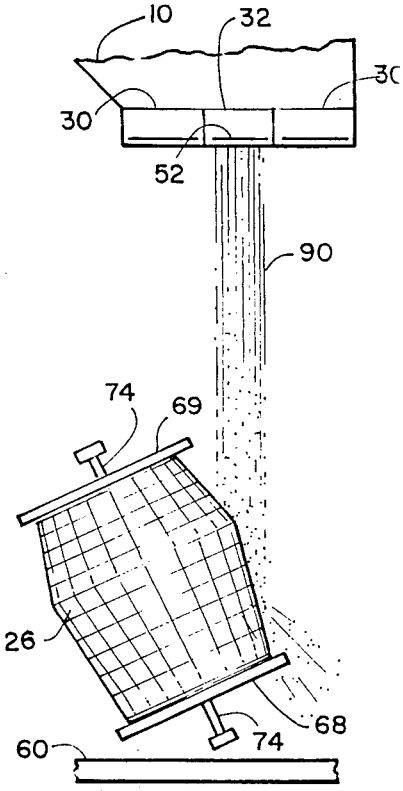
FIG. 8 is a schematic elevation view illustrating deburring of the second side of circumferential ribs.

FIGS. 6, 7 and 8 schematically illustrate the orientation of a frusto-conical structure having both longitudinal or axial ribs and circumferential ribs for shot deburring of substantially all sharp edges on ribs in an automatic, non-labor-intensive manner.

In order to deburr longitudinal ribs, the apparatus is set up as seen in FIG. 6. Fixture 18 is adjusted so that the axis of structure 26 is substantially horizontal. Elongated dispensing hoppers 30 are positioned so that elongated slots 48 and 50 are parallel with and substantially tangential to the structure, overlapping sufficiently so that the shot streams 88 primarily strike only the rib sides as the structure is rotated. Rotation and shot impact are continued until the empirically determined period for full deburring passes, plus a short additional period. The shot stream and structure rotation means are turned off and the structure reoriented as schematically illustrated in FIG. 7. Frame 54 is moved until one side of all of the circumferential ribs are exposed to a shot stream 90 falling from central dispensing hopper 32 which has a square or short rectangular pattern of openings 52 sufficient to impact all circumferential ribs 66. Again, the structure is rotated until all edges exposed to the shot stream are deburred. The apparatus is stopped and frame 26 is reoriented to the position shown in FIG. 8 to bring the opposite sides of the circumferential ribs into contact with shot stream 90. Rotation of structure 32 is continued until the desired deburring is achieved.

FIGS. 9 and 10 schematically illustrate how full self-limiting deburring of sharp edges 92 is achieved without damaging either the basic structure of ribs 94 or thin skin 96.

A vertical section through a typical rib and skin making up a portion of a structure 26 is illustrated in FIG. 2. Skin 96 has a plurality of ribs 94 extending upwardly thereof. In many aerospace applications the size, shape, spacing, etc., is critical to provide the optimum combination of light weight and high strength. Ribs 94 are generally produced by methods such as machining or chemical milling which produce one or more sharp edges or burrs 92 lying along each rib 94. Edges 92 must be removed, since they cause stress concentrations which can result in cracks in the ribs. Ideally, edges are rounded over to a selected radius which gives maximum cracking resistance and highest rib strength.

An individual shot 98 falls along a vertical line 100 in FIG. 9 and directly impacts sharp edge 102. The energy in shot 80 is sufficient to deform or round over sharp edge 102. However, the energy in shot is selected (empirically, by selecting shot density, size, drop height, etc.) so as to be insufficient to distort flat or rounded surfaces such as the body of a rib 94. As edge 102 is repeatedly impacted, rounding continues until a radius is achieved which can resist the shot impact. No significant further changes in that radius occur with further impacts, the deburring being thus self-limiting with the radius obtained being a function of shot density, size and drop height.

The structure skin 96 within each rib pocket is relatively thin and would be deformed if directly impacted by shot 98. However, the method and apparatus of this invention inherently protects those skin areas. The surface of skin 96 should always be at a small angle to the vertical shot path, preferably less than about 30°. As seen in FIG. 10, shot falling vertically along line 100 strike skin 96 only a light, glancing, blow with insufficient energy to damage the skin.

The size, density and drop height for the shot as used in this invention will depend upon the material being deburred and the radius of deburred edges desires. Simple tests with a specific structure material, using different shot and/or drop heights and comparing the edge radius obtained can be used to determine the optimum parameters. A variety of suitable shot are available, for example, from the Pangborn Company under the "Rotoblast" trademark. I have found that excellent results are obtained on titanium structures with cast steel shot having diameters of from about 0.06 to 0.1 inches dropped from a height of from about 6 to 10 feet. If desired, the apparatus may be provided with conventional means for varying the height of either the dispensing hoppers or the structure supporting fixture so that different radii can be obtained with the same shot, or so that different materials may be deburred. Typically, with titanium and size 550 (screen No. 10, screen aperture 0.0787 in.) steel shot, I have found that a 5 foot drop height produces an edge radius of about 0.005 inch, with a 7 foot drop producing about a 0.008 inch radius and a 9 foot drop about a 0.010 inch radius.

While certain specific materials, arrangements and configurations have been detailed in the above description of preferred embodiments, these can be varied, where suitable, with similar results. For example, the fixture can be positioned to deburr ribs lying at angles to the structure axis other than the detailed circumferential and axial ribs.

Other variations, applications and ramifications of this invention will occur to those skilled in the art upon reading this disclosure. Those are intended to be included within the scope of this invention, as defined in the appended claims.

I claim:

1. In a shot peening apparatus having a fixture for holding a structure to be impacted with shot, a collection hopper below said fixture to collect shot following against and past said structure, a lifting means for lifting shot from said hopper to a dispensing means above said fixture and means to direct shot to fall from said dispensing means in at least one stream against said structure, the improvement wherein:

said fixture includes a generally rectangular frame adapted to support said structure therein with the axes of said structure lying in the plane of said frame, motor drive means on said frame adapted to rotate said structure about its axis, said frame mounted in a framework, motor drive means on said framework adapted to rotate said structure about an axis perpendicular to the axis of said structure, a truck supporting said framework and caster means on said truck for permitting said fixture and structure to be easily moved across a floor;

a structure supported by said fixture comprising a skin which is a surface of revolution and a plurality of ribs extending outwardly from said skin to form a pattern of pockets, said ribs having sharp edges on the sides thereof extending along lines generally parallel to said skin;

rotation means in said fixture for rotating said structure about its axis;

angular adjustment means in said fixture for tilting the axis of said structure;

whereby said sharp edges may be brought into alignment with the shot stream falling from said dispensing means so that said shot directly strikes said edges while striking said skin at angles less than about 30° to round over said edges without adversely affecting said skin and ribs.

2. The improvement according to claim 1 wherein said structure is formed from titanium, said shot comprise steel spheres having average diameters of from about 0.06 to 1.0 in. and the distance between said dispensing means and said impact area on said rib edges is from about 6 to 10 feet.

3. The improvement according to claim 1 wherein said first set of said ribs runs axially and a second set of said ribs runs circumferentially of said structure and said means to direct shot fall includes a plurality of dispensing hoppers having dispensing slots configured to be selectively alignable with said first and second sets of ribs.

4. In a shot peening apparatus having a fixture for holding a structure to be impacted with shot, a collection hopper a structure to be impacted with shot falling against and past said fixture, a lifting means for lifting shot from said hopper to a dispensing means above said fixture means to direct shot from said dispensing means to fall in a stream against said structure, the improvement wherein said dispensing means comprises:

at least two spaced dispensing hoppers;

means for selectively directing at least some shot from said lifting means to said two dispensing hoppers;

each of said two dispensing hoppers having a removable plate which closes the outlet end of said hopper, each plate having an elongated slot of selected configuration through which shot can fall in a narrow stream toward said fixture; and said slots having shapes corresponding to the plan profile of said structure when said structure in said fixture is rotated about a substantially horizontal axis;

whereby said two elongated slots are adapted to direct tangential narrow shot streams against the edges of said structure in said fixture.

5. The improvement according to claim 4 wherein said dispensing means further includes:

a third dispensing hopper located adjacent to said two dispensing hoppers;

means to selectively direct shot from said lifting means to either said two dispensing hoppers or said third dispensing hopper; and said third dispensing hopper having a removable plate closing the outlet thereof, said plate having at least one slot in the bottom thereof through which shot can fall in a stream toward said fixture;

whereby shot from said third dispensing hopper can impact an circumferential segment of a structure in said fixture being rotated about an axis at an obtuse angle to said stream.

6. The improvement according to claim 4 wherein said structure is formed from titanium, said shot are steel spheres having diameters of from about 0.06 to 1.0 in. and the distance between said dispensing means and the impact areas on said structure is from about 6 to 10 feet.

7. An apparatus for deburring and rounding sharp edges on the sides of ribs on a structure which comprises a skin which is a surface of revolution and which has a plurality of upstanding ribs, said ribs having sharp edges on the rib sides, which comprises:

a fixture adapted to support said structure;

rotation means on said fixture for rotating said structure about its axis;

angular adjustment means for tilting said structure axis;

a collection hopper below said fixture for receiving shot falling against and past said structure in said fixture;

lifting means for carrying said shot from said collection hopper to a dispensing means above said fixture;

said dispensing means including means for selectively directing shot to at least one of a plurality of dispensing hoppers;

two of said dispensing hoppers having removable plates closing the outlet ends of said hoppers, said plates having elongated slots of selected configuration adapted to direct narrow streams of shot toward said structure in said fixture;

said removable plates permitting selection of the slot shapes and locations so that two narrow streams can be directed tangentially against edges of said structure when said structure is rotated substantially horizontally about its axis;

whereby the shot streams directly impact the sharp rib edges and impact said skin at a small angle.

8. The apparatus according to claim 7 further including a third hopper having a removable plate closing the outlet thereof, said plate having at least one bottom opening shaped and located so that a shaped stream of shot can be directed tangentially against circumferential ribs on said structure when said structure is rotated about its axis with said axis at an obtuse angle to the stream of falling shot.

9. The apparatus according to claim 7 wherein said structure is formed from titanium, said shot are steel spheres having diameters of from about 0.06 to 0.1 in. and the distance between said dispensing hopper slots and the impact areas on said structure is from about 6 to 10 feet.

10. The method of deburring and rounding sharp edges on a structure which comprises the steps of:

providing a structure which is a surface of rotation and comprises a skin having outwardly directed ribs, said ribs having sharp edges lying along lines generally parallel to said skin on the sides of said ribs;

directing at least one stream of shot by gravity from a dispenser directly against said sharp edges, allowing only grazing contact with said skin;

selecting shot size and density and height of shot drop to produce rounding of said edges to a desired radius without significant deformation of other impacted areas;

moving said structure to bring all sharp edges into direct impingement by said stream while preventing direct impingement of said shop on said skin at angles greater than about 30°; and collecting shot which has dropped past said structure and returning it to said dispenser.

11. The method of deburring and rounding sharp edges on a structure which is a surface of rotation and comprises a skin having outwardly directed ribs, said ribs having said sharp edges lying along lines generally parallel to said skin on the sides of said ribs, which comprises the steps of:

providing at least one dispenser above the structure, said dispenser outlet closed with a removable plate having a slot permitting shot to pass therethrough;

selecting and installing a plate having a slot having a configuration appropriate to said structure;

directing at least one stream of shot directly against said sharp edges, allowing only grazing contact with said skin;

selecting shot size, density, and velocity to produce rounding of said edges to a desired radius without further deformation beyond the desired radius and significant deformation of other impacted areas;

moving said structure to bring all sharp edges into direct impingement by said stream while preventing direct impingement of said shot on said skin at angles greater than about 30°; and collecting shot which has dropped past said structure and returning it to said dispenser.

* * * * *